US005522287A

United States Patent [19]

Chiang

[11] Patent Number: 5,522,287

[45] Date of Patent: Jun. 4, 1996

[54] RATCHET HANDLE OF SOCKET WRENCH

[76] Inventor: Chen-Chi Chiang, 3/F., No. 13, Alley 100, Lane 155, Tun Hwa N. Rd., Taipei, Taiwan

[21] Appl. No.: 430,546

[22] Filed: Apr. 28, 1995

[51] Int. Cl.[6] ..... B25B 13/46

[52] U.S. Cl. ..... 81/60; 81/177.9; 81/125.1

[58] Field of Search ..... 81/60–63.1, 177.8, 81/177.9, 125.1

[56] References Cited

U.S. PATENT DOCUMENTS

| | | | |
|---|---|---|---|
| 1,578,065 | 3/1926 | Bemus et al. | 81/62 X |
| 2,803,980 | 8/1957 | Vogel | 81/60 X |
| 2,851,914 | 9/1958 | Zeckzer | 81/62 X |
| 3,383,962 | 5/1968 | Harris | 81/177.9 |
| 4,662,251 | 5/1987 | Kohal | 81/60 X |
| 5,211,087 | 5/1993 | Thomason | 81/63 X |

*Primary Examiner*—James G. Smith
*Attorney, Agent, or Firm*—Bacon & Thomas

[57] ABSTRACT

A socket wrench ratchet handle structure includes an elongated handle body having at least a ratchet head mounted to a first end thereof. The ratchet head has a through hole formed thereon to receive therein a driving member which a first driving plug and a second driving plug extending therefrom to respectively project out of two opposite faces of the ratchet head along opposite directions. The first and second driving plugs are of different specifications for engaging sockets of different specifications so as to allow a single ratchet handle to be used with sockets of two different specifications without the use of an adaptor. The ratchet head is also provided with a direction setting tab on each of the two opposite faces for the convenience of setting the driving direction for both the first and second driving plugs. Further, an orientation adjusting device may be provided between the ratchet head and the handle body to set the socket fit on the driving plugs toward any desired direction. The handle body may be provided on a second end thereof with a second ratchet head of the same structure so as to provide a single ratchet handle with four driving plugs of different specifications. The second ratchet head may be replaced by a single, co-axially-extending driving plug for driving bolts in deep holes. A knuckle joint may be provided between the coaxial driving plug and the handle body.

7 Claims, 12 Drawing Sheets

RATCHET HANDLE OF SOCKET WRENCH

FIELD OF THE INVENTION

The present invention relates generally to a socket wrench and in particular to a ratchet-handled socket wrench which has a ratchet head with two socket driving plugs of different specifications extending therefrom along opposite directions so as to allow a single ratchet handle to be used with sockets of two different specifications.

BACKGROUND OF THE INVENTION

Bolts have been widely used in securing or retaining mechanical parts. However, tightening/loosening bolts on complicated machines or devices is a time- and labor-consuming job. Socket wrench with ratchet handle, which is well known and is shown in FIG. 12 of the attached drawings to be designated with the reference numeral 40, provides a more time-efficient way to tighten/loosen bolts. The conventional ratchet handle for socket wrench 40 shown in FIG. 12 is only capable to use with sockets of a particular specification that match the particular driving plug 41 of the socket wrench 40. For a socket 55 having different specifications, an adaptor 4 has to be connected between the driving plug 41 and the socket 55. The conventional ratchet handle 40 is also provided with a driving direction setting mechanism 42 which allows a user to set the direction along which the ratchet handle 40 may apply torque to the socket 55.

Another problem encountered in using the conventional ratchet handle is that the bolts that are mounted on a complicated machine may be located at such a hard-to-reach position, such as a deep hole, or so oriented in awkward direction as to prevent a user from using the conventional ratchet handle to screw or un-screw the bolts.

It is therefore desirable to provide an improvement of the ratchet handle of socket wrench to overcome the problems.

SUMMARY OF THE INVENTION

The principal object of the present invention is to provide an improved ratchet handle of socket wrench which has two driving plugs of different specifications mounted on two opposite faces of the ratchet head that is mounted to one end of the handle to respectively engage sockets of different specifications without the use of an adaptor.

It is another object of the present invention to provide an improved ratchet handle having a ratchet head mounted to each of two opposite ends of the handle, each of the ratchet heads having two driving plugs of different specifications mounted to two opposite faces thereof so as to provide a single ratchet handle with four driving plugs of different specifications for use with sockets of four different specifications.

It is a further object of the present invention to provide a ratchet handle having a ratchet head mounted to an end thereof via orientation adjusting device, comprising a knuckle joint, so as to allow the ratchet head to be oriented toward any desired direction.

It is a further object of the present invention to provide a ratchet handle having a ratchet head mounted to a first end thereof for normal driving operation of bolts and an co-axially-extending driving plug mounted to a second end thereof to engage with socket that is substantially co-axial with the handle for driving bolts located in a hard-to-reach position or a deep hole.

It is a further object of the present invention to provide a ratchet handle with a ratchet head having two driving plugs mounted to a first end thereof and an individual driving plug mounted to an opposite, second end thereof with a knuckle joint connected between the individual driving plug and second end of the handle.

In accordance with the present invention, there is provided a socket wrench ratchet handle structure comprising an elongated handle body having at least a ratchet head mounted to a first end thereof. The ratchet head has a through hole formed thereon to receive therein a driving member which a first driving plug and a second driving plug extending therefrom to respectively project out of two opposite faces of the ratchet head along opposite directions. The first and second driving plugs are of different specifications for engaging sockets of different specifications so as to allow a single ratchet handle to be used with sockets of two different specifications without the use of an adaptor. The ratchet head is also provided with a direction setting tab on each of the two opposite faces for the convenience of setting the driving direction for both the first and second driving plugs. Further, an orientation adjusting device may be provided between the ratchet head and the handle body to set the socket fit on the driving plugs toward any desired direction. The handle body may be provided on a second end thereof with a second ratchet head of the same structure so as to provide a single ratchet handle with four driving plugs of different specifications. The second ratchet head may be replaced by a single, co-axially-extending driving plug for driving bolts in deep holes. A knuckle joint may be provided between the co-axial driving plug and the handle body.

BRIEF DESCRIPTION OF THE DRAWINGS

The present invention will be better understood from the following description of preferred embodiments of the present invention, with reference to the attached drawings, wherein.

DETAILED DESCRIPTION OF THE PREFERRED EMBODIMENTS

Figure 1:
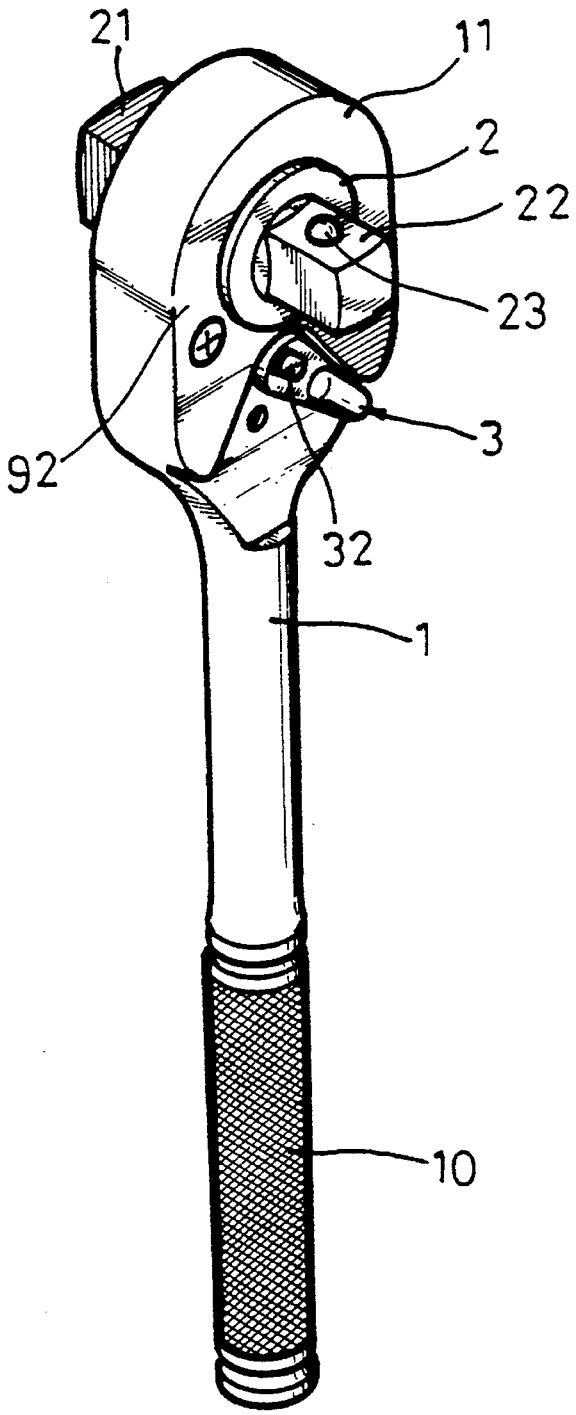
FIG. 1 is a perspective view showing a ratchet handle of socket wrench constructed in accordance with a first embodiment of the present invention.

The present invention will be described in detail by means of several embodiments illustrated in the drawings, in which similar parts is designated with similar reference numeral through all the drawings.

Figure 2:
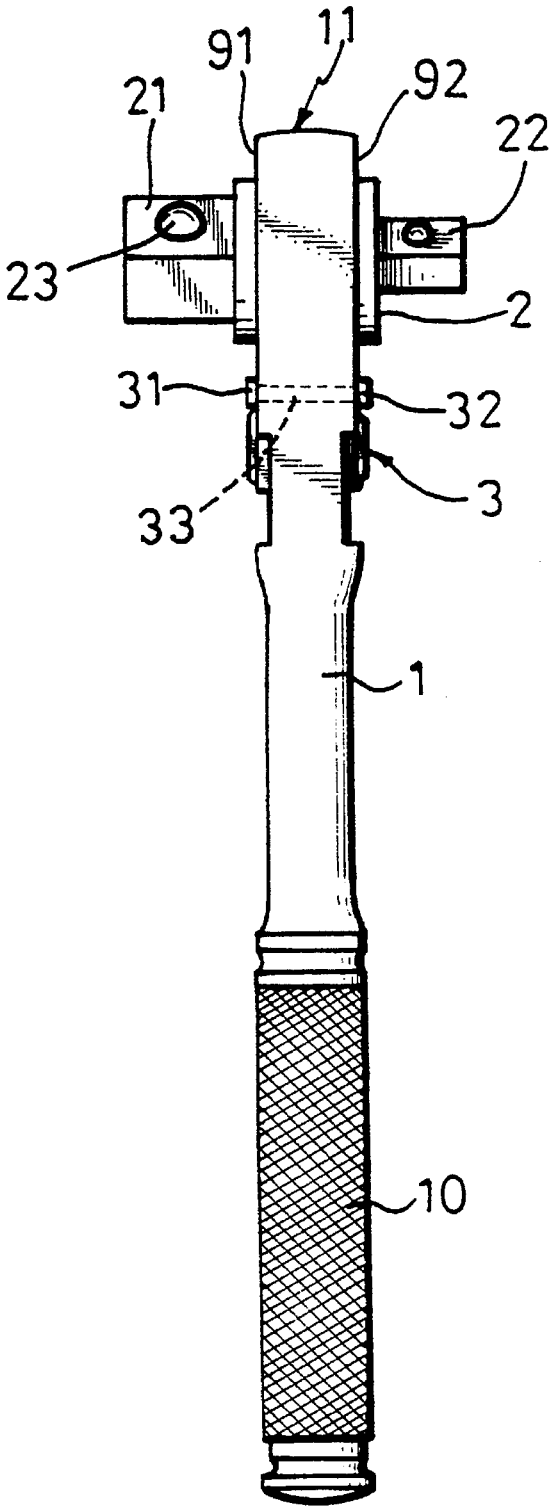
FIG. 2 is a side view of the ratchet handle of the first embodiment of the present invention.

With reference to the drawings and in particular FIGS. 1 and 2, wherein a ratchet handle of a socket wrench constructed in accordance with a first embodiment of the present invention is shown, the ratchet handle in accordance with the present invention comprises an elongated handle body 1 having a first end 11 (or upper end, as viewed in the drawings) to which a ratchet head is mounted and a second end 10 (or lower end, as viewed in the drawings) on which knurl may be formed to serve as a handhold. In the embodiment illustrated, the ratchet head 11 has two opposite faces, the first face 91 and the second face 92, see FIG. 2. For simplicity, the handhold portion and the ratchet head portion may also be referenced to by means of numerals 10 and 11.

Figure 12:
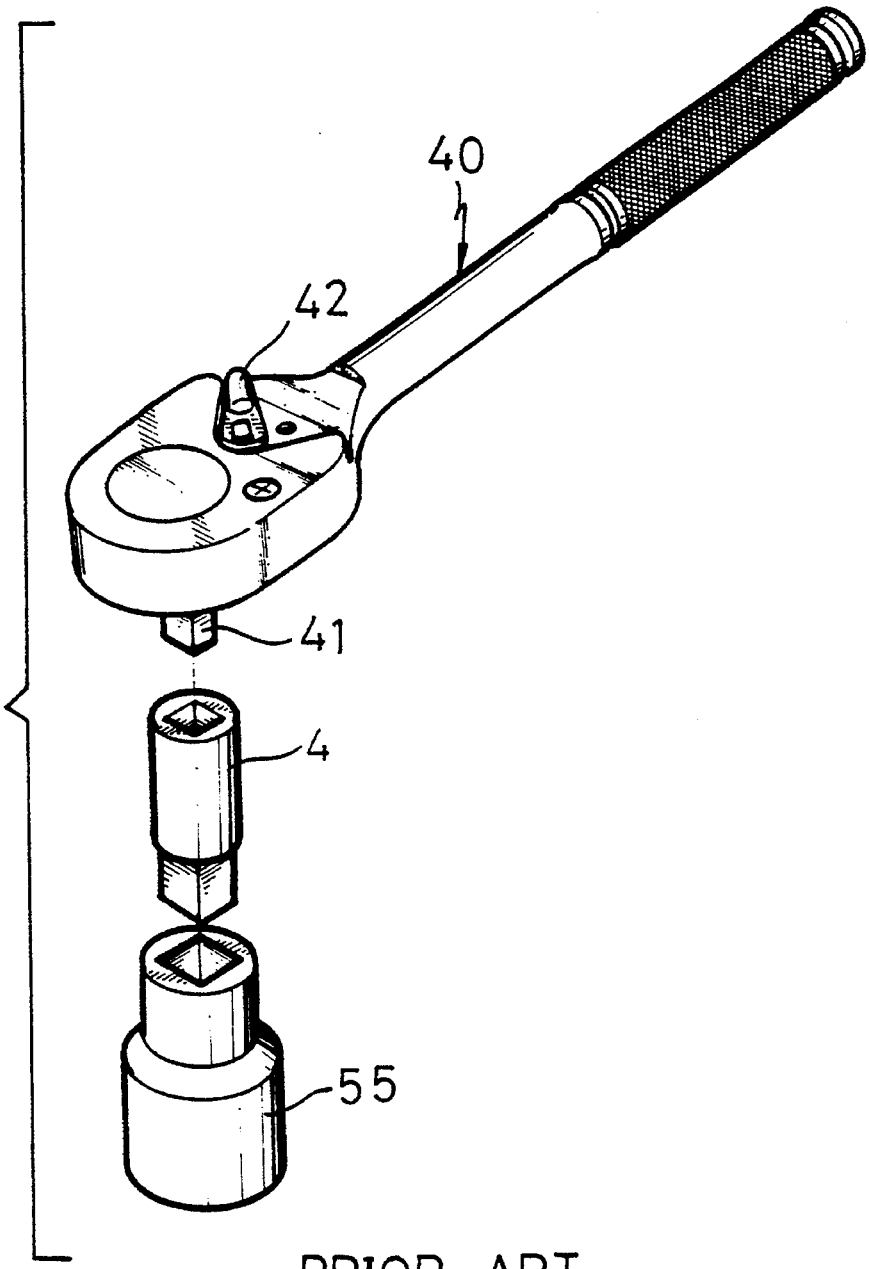
FIG.12 PRIOR ART
FIG. 12 is a perspective view showing a prior art ratchet-handled socket wrench.

The ratchet head 11 comprises a driving member 2 rotatably mounted within a through hole formed on the ratchet head 11. The driving member 2 has a first driving plug 21 and a second driving plug 22 laterally extending therefrom to respectively project out of the first and second faces 91 and 92 of the ratchet head 11 along opposite directions. The first and second driving plugs 21 and 22 are preferably of different specifications so as to be engageable with sockets of different specifications, such as sockets 51 and 52 shown in FIG. 3 that have different-sized engaging holes 511 and 521. This allows a single ratchet handle to be used with sockets of two different specifications and thus eliminating the use of an adaptor 4 (see FIG. 12 which shows a prior art ratchet-handled socket wrench designated with reference numeral 40) as conventionally used.

Each of the driving plug 21 or 22 may be provided with spring-biased retaining balls 23 which, when the socket 51 or 52 is fit over the respective driving plugs 21 or 22, serves to securely retain the socket 51 and 52 on the driving plug 21 or 22 with friction therebetween. This is a well known technique.

In operation, a user may select a desired one between the sockets 51 and 52 and fit the selected socket 51 or 52 onto the corresponding driving plug 21 or 22. Due to a ratchet mechanism between the driving member 2 and the ratchet head 11, which is in general known to those having ordinary skills in the art and thus need no description herein, the rotation of the handle body 1 with force applied on the handhold 10 causes the driving member 2 and thus the socket 51 or 52 to rotate and thus drive for example a bolt (not shown).

To set the direction for driving the bolt through the socket 51 or 52, driving direction setting means 3 is provided on the ratchet head 11. The direction setting means 3 comprises a first setting tab 31 (see FIG. 2) movably mounted on the first face 91 of the ratchet head 11 and a second setting tab 32 movably mounted on the second face 92 of the ratchet head 11. The first and second setting tabs 31 and 32 are so connected together as to be rotatable about a common axle 33 (FIG. 2) and thus moveable in unison with each other. This allows setting action applied on either one of the setting tabs 31 and 32 causes the same result in setting the driving direction of the driving member 2. The direction setting mechanism that connects between the direction setting means 3 and the driving member 2 is in general known to those having ordinary skills in the art and thus need no description herein.

Figure 3:
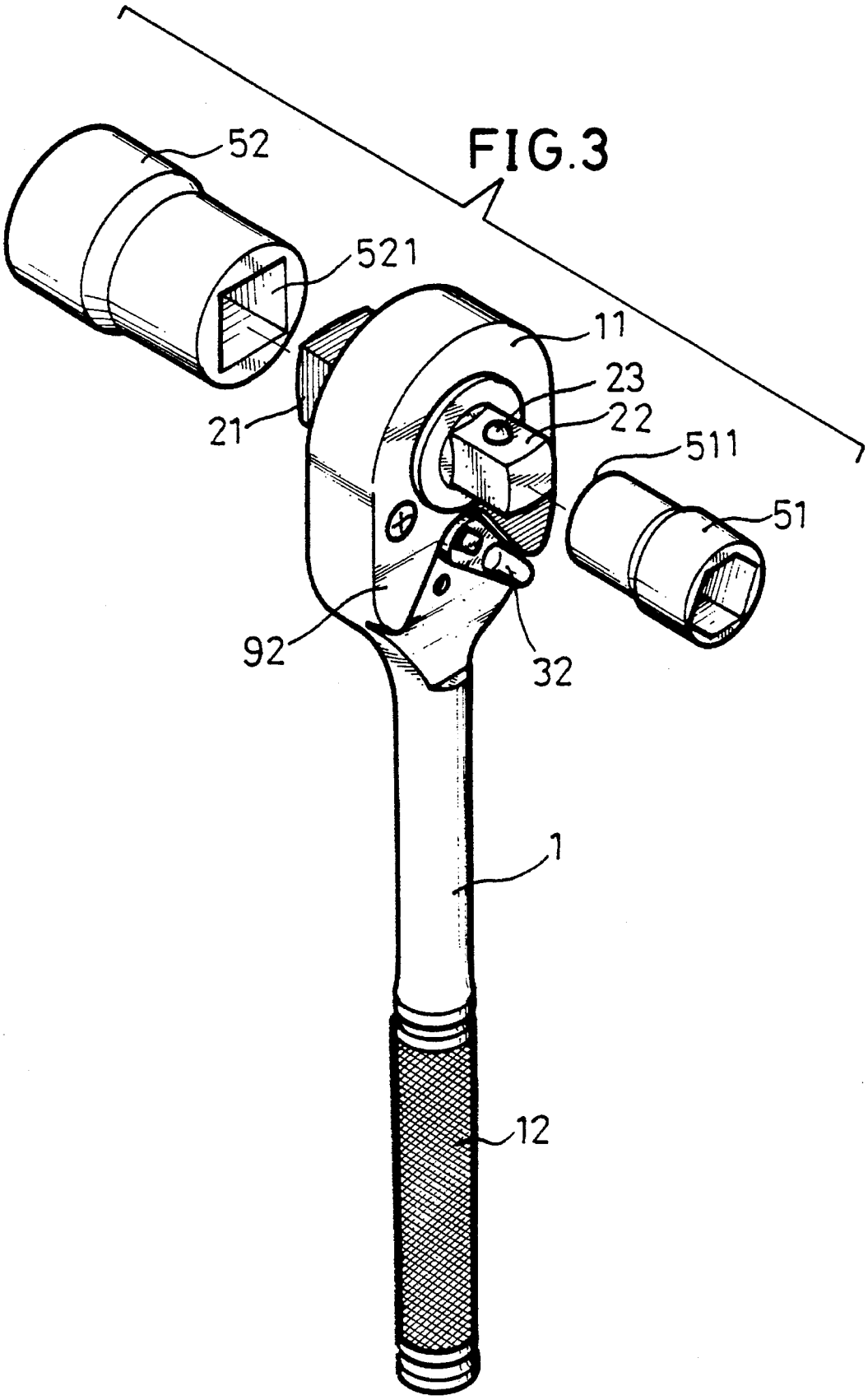
FIG. 3 is a perspective view showing the ratchet handle of the first embodiment of the present invention with sockets to be mounted thereto.
Figure 4:
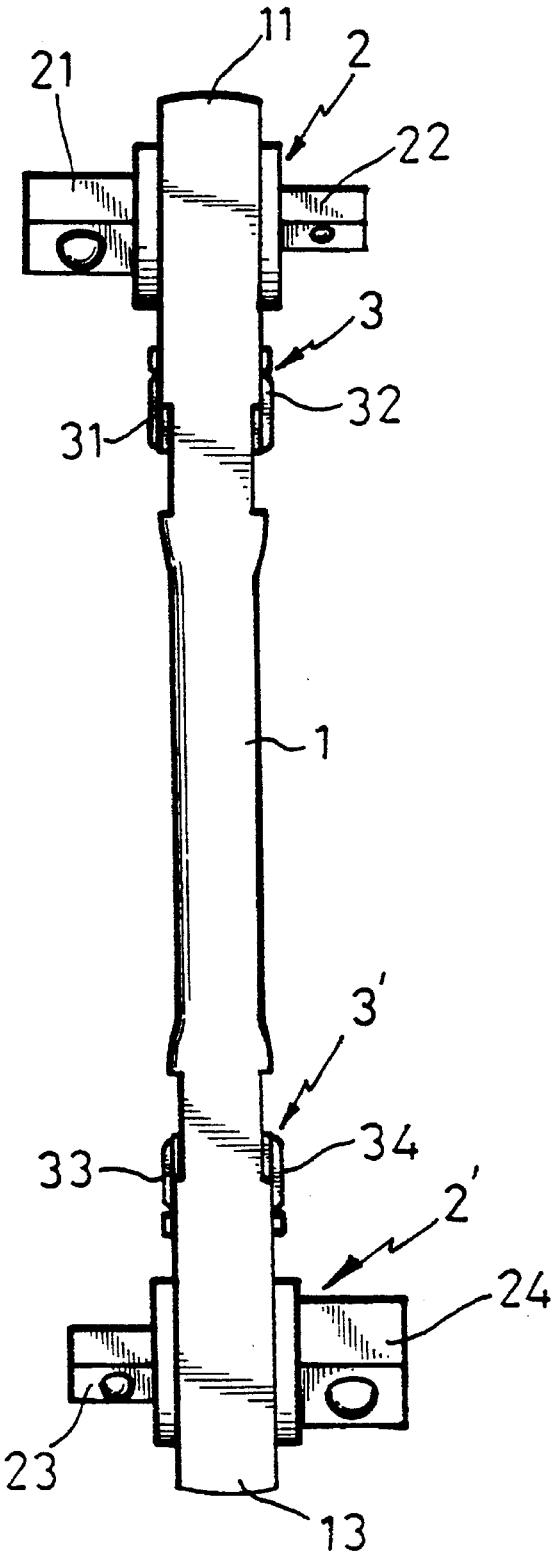
FIG. 4 is a perspective view showing a ratchet handle of socket wrench constructed in accordance with a second embodiment of the present invention.

As an expansion of the design idea applied to the first embodiment of the present invention illustrated in FIGS. 1–3, a ratchet handle of socket wrench in accordance with a second embodiment of the present invention is shown in FIG. 4, in which the ratchet handle comprises an elongated handle body 1 having an upper end 11 on which a first ratchet head is formed which comprises a driving member 2 having two different-sized driving plugs 21 and 22 and direction setting means 3 having two setting tabs 31 and 32, similar to the first embodiment illustrated in FIGS. 1–3, and a lower end 13 on which a second ratchet head is formed. The second ratchet head 13 is similar in structure to the first ratchet head 11 and thus comprises a second driving member 2' having two different-sized driving plugs 23 and 24 which are also of different specifications from those of the driving plugs 21 and 22 of the first driving member 2 and second direction setting means 3' having two setting tabs 33 and 34. The structures of the second driving member 2' and the second direction setting means 3' are similar to those of the first driving member 2 and the first direction setting means 3, with the only exception that driving plugs 23 and 24 of the second driving member 2' are of different specifications from those of the driving plugs 21 and 22 of the first driving member 2. This arrangement provides a user with four choices in using sockets of different specifications.

Figure 5:
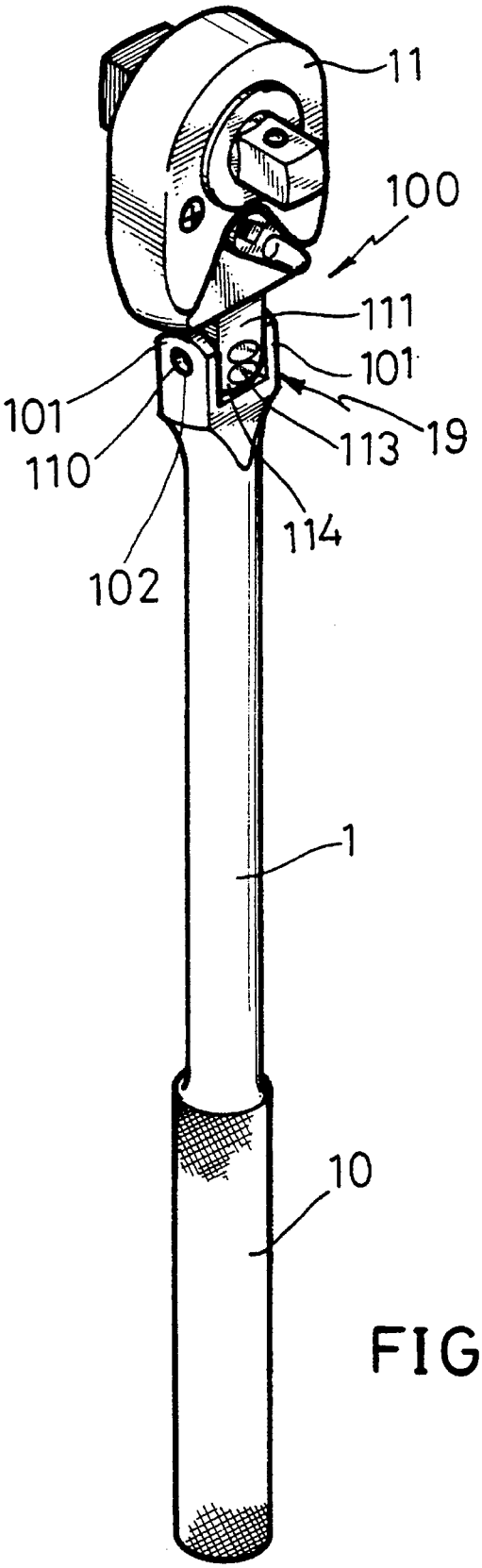
FIG. 5 is a perspective view showing a ratchet handle of socket wrench constructed in accordance with a third embodiment of the present invention.
Figure 6:
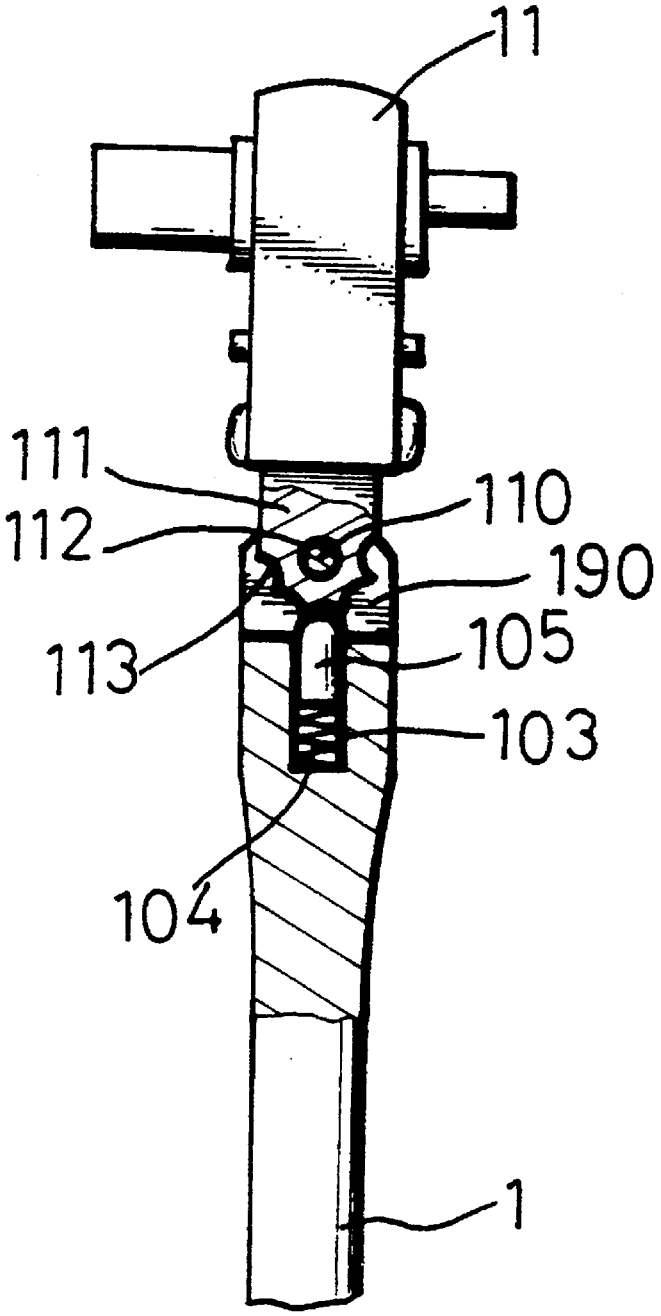
FIG. 6 is a side view, partially broken, showing the inside structure of the orientation adjusting device adapted in the ratchet handle of the third embodiment of the present invention.

In FIGS. 5 and 6, a third embodiment of the present invention is shown, in which a ratchet handle of socket wrench is provided, comprising an elongated handle body 1 having a lower, knurled end 10 and an upper end 19 to which a ratchet head 11 is connected via a knuckle joint 100. The upper end 19 has two spaced side walls 101 defining therebetween a recess 190 for receiving an extension 111 of the ratchet head 11 with a pivot 110 extending through holes 102 formed on the side walls 101 and a hole 112 (FIG. 6) formed on the extension 111 of the ratchet head 11 so as to pivot the ratchet head 11 to the upper end 19 of the handle body 1.

The ratchet head 11 comprises orientation adjusting means which comprises a round free end 114 formed on the extension 111 of the ratchet head 11 with a plurality of dimples 113 formed thereon to be disposed within the recess 190.

Figure 7:
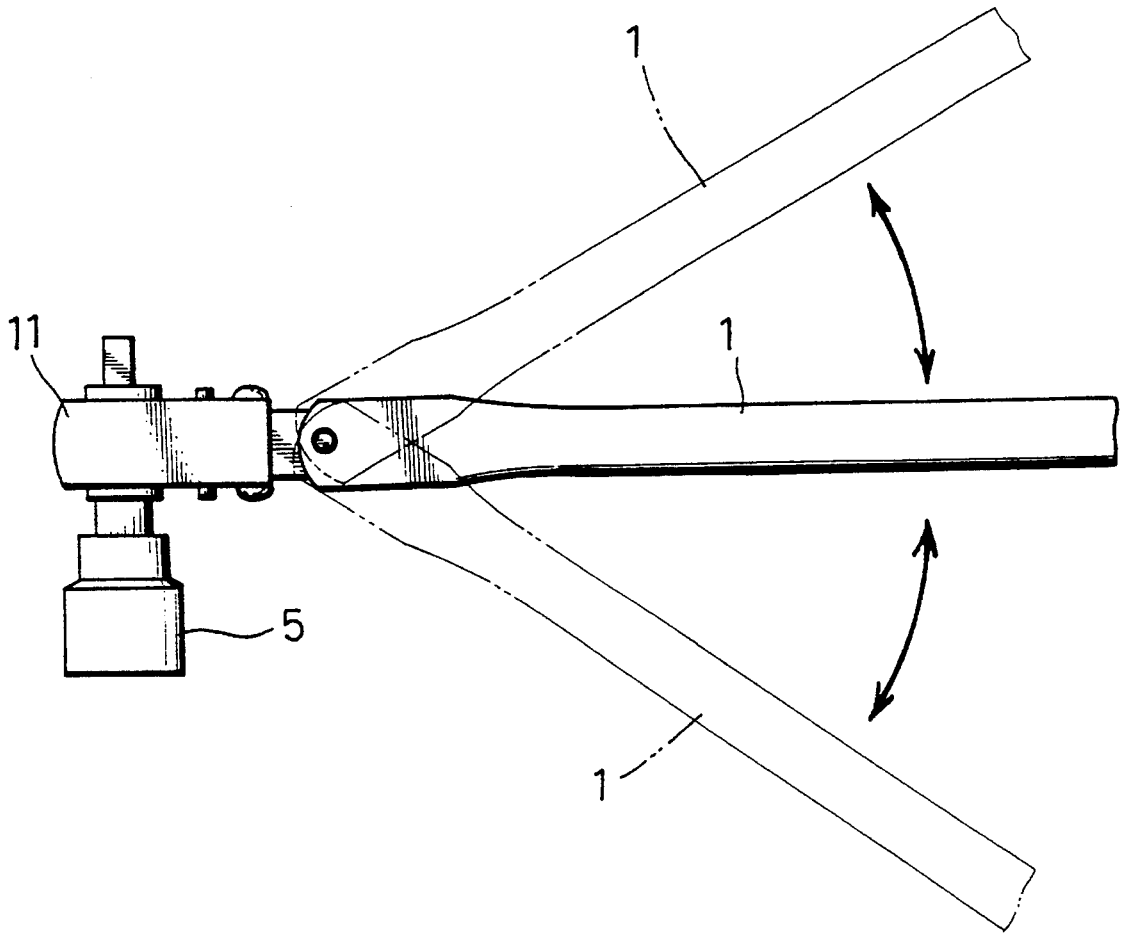
FIG. 7 is a side view showing a socket wrench using the ratchet handle constructed in accordance with the third embodiment of the present invention.

The orientation adjusting means further comprises a retaining block 105 received within a hole 103 formed within the recess 190 of the upper end 19 of the handle body 1. The retaining block 105 which is received within the hole 103 is biased by a spring 104 in a direction toward the extension of the ratchet head 11 to be selectively engageable with one of the dimples 113 formed on the extension 111 of the ratchet head 11 for retaining the ratchet head 11 at an angle associated with a selected, particular dimple 113. Three different angular positions of the ratchet head 11 relative to the handle body 1 is shown in FIG. 7, of which two are shown by phantom lines. A socket 5 is also shown in FIG. 7, engaged by one of the driving plugs of the ratchet head 11.

Figure 8:
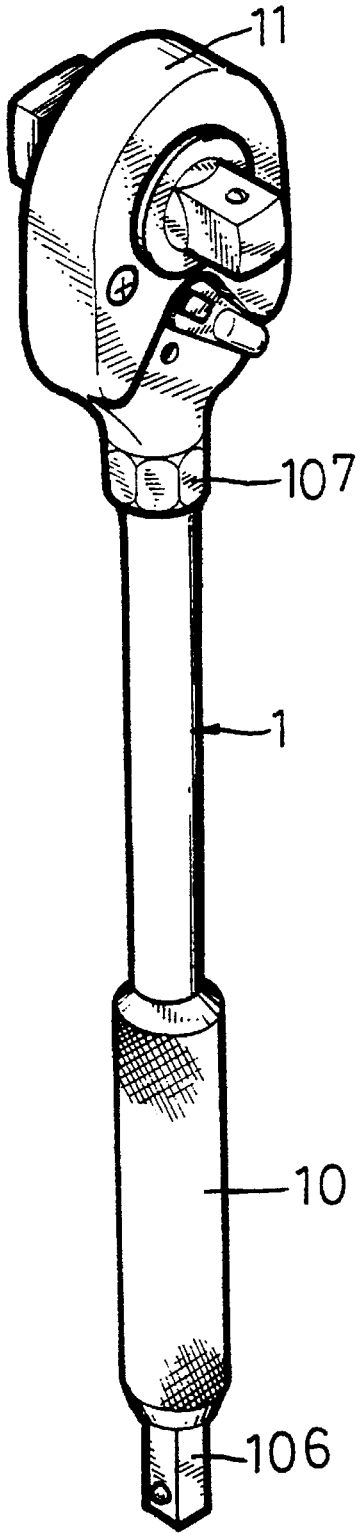
FIG. 8 is a perspective view showing a ratchet handle of socket wrench constructed in accordance with a fourth embodiment of the present invention.
Figure 9:
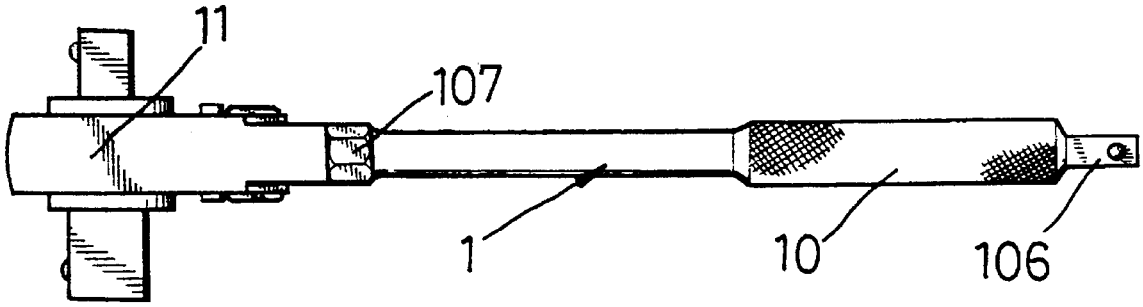
FIG. 9 is a side view of the ratchet handle of the fourth embodiment of the present invention.
Figure 10:
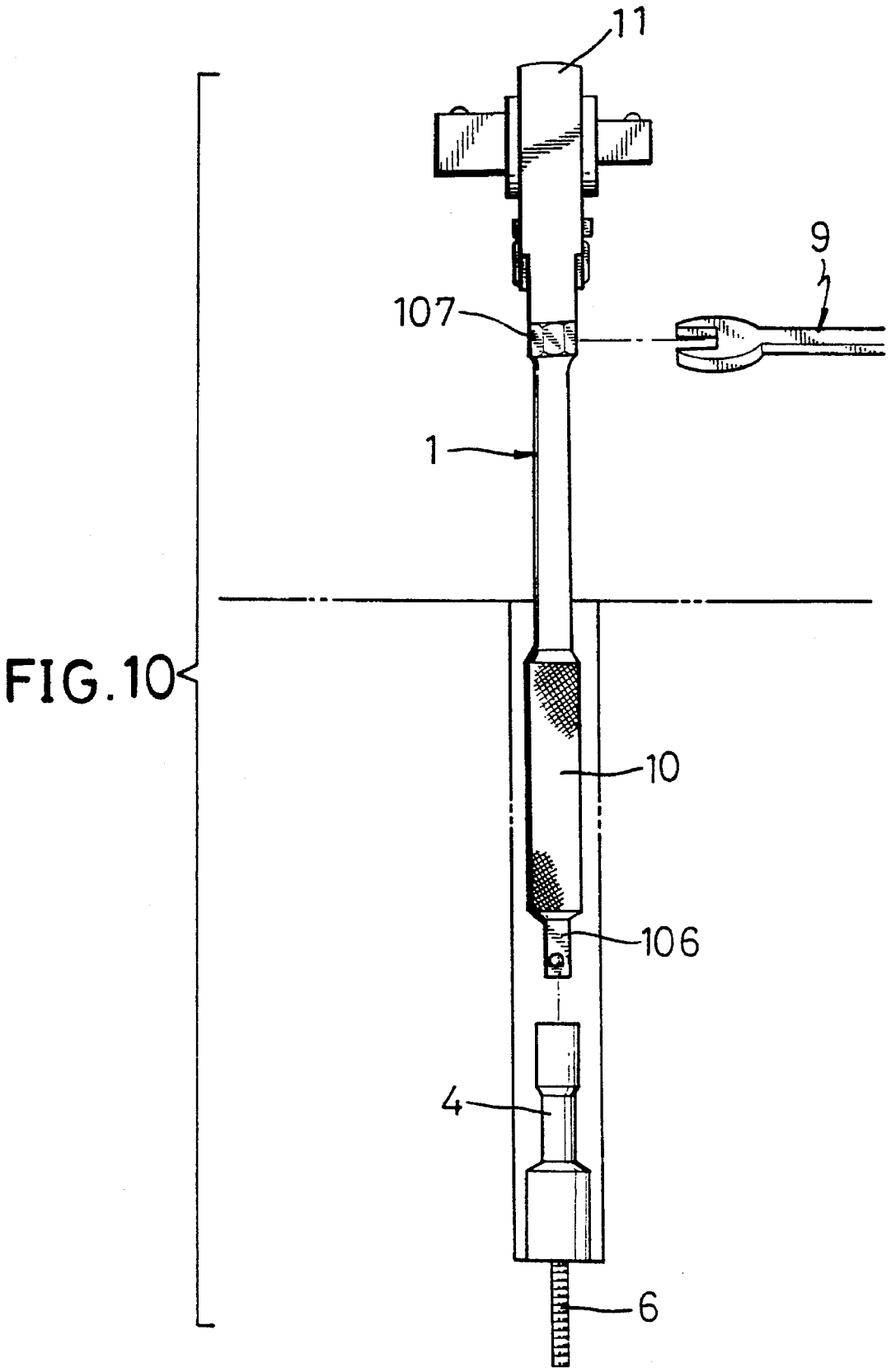
FIG. 10 is a side view showing an application of the socket wrench constructed in accordance with the fourth embodiment of the present invention to screw a bolt in a deep hole.

A fourth embodiment of the present invention is shown in FIGS. 8 and 9, which is particularly suitable for working on bolts within deep holes, such as the situation shown in FIG. 10. In accordance with the fourth embodiment of the present invention, a ratchet handle of socket wrench comprises an elongated handle body 1 having a lower end on which knurl 11 is formed and an upper end to which a ratchet head 11 having the structure similar to that described with reference to FIGS. 1 and 2 is mounted with an intermediate section 107 having a polygonal cross section, preferably hexagon, formed therebetween. The knurled end 10 has an extended section 106 extending along a lengthwise or axial direction of the handle body 1. The extended section 106 is made in the form of a driving plug similar to the driving plugs 21 and 22 of the ratchet head 11 so as to be engageable with a bolt 6, see FIG. 10, located in a deep hole via an adaptor 4. In operation, the user may use an open-ended wrench 9 to engage the hexagonal section 107 to apply a torque to the handle body 1 for driving the bolt 6.

Figure 11:
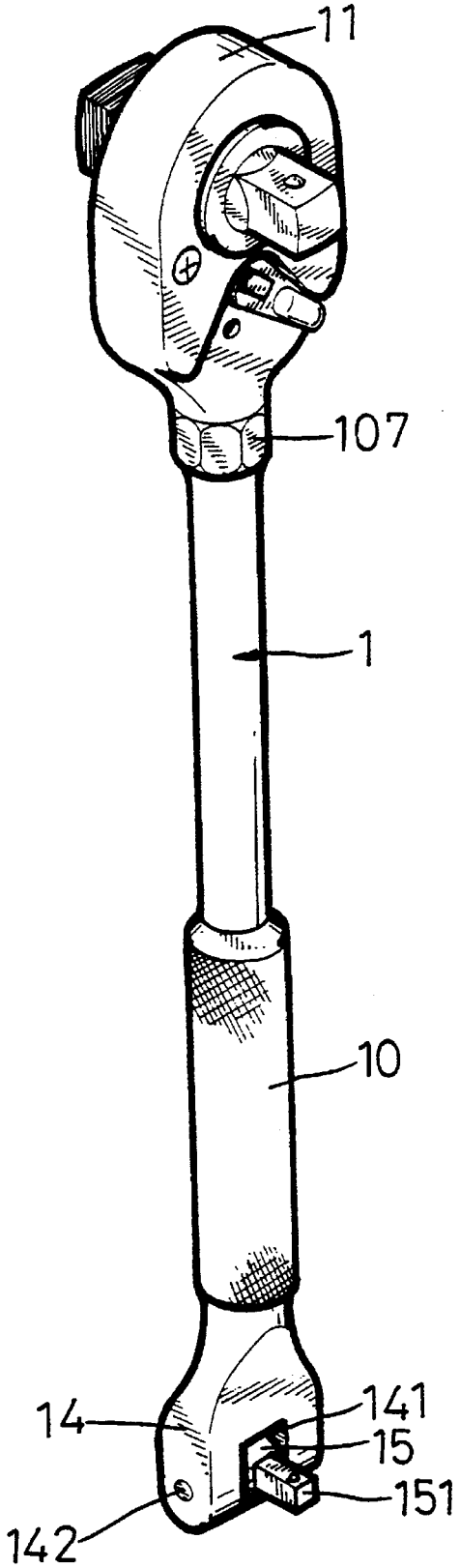
FIG. 11 is a perspective view showing a ratchet handle constructed in accordance with a fifth embodiment of the present invention.

A further embodiment of the present invention is shown in FIG. 11 in which an elongated handle body 1 has an upper end with a ratchet head 11 mounted thereto and a knurled lower end 10 to which a driving plug 151 is rotatably mounted via a knuckle joint 14 which comprises a recess 142 formed on the lower end 10 of the handle body 1 to receive and rotatably retain therein a base 15 of the driving plug 151 by means of a pivot 142. The driving plug 151 may be made to be free to rotate relative to the handle body 1 or orientation adjusting means may be provided between the recess 141 of the lower end 10 of the handle body 1 and the base 15 of the driving plug 151 to retain the driving plug 151 at any desired orientation. Such orientation adjusting means may be similar to the orientation adjusting means discussed with reference to FIGS. 5–7 or other devices having similar function.

It is apparent that although the invention has been described in connection with the preferred embodiments, it is contemplated that those skilled in the art may make changes to the preferred embodiments without departing from the scope of the invention as defined in the appended claims.

What is claimed is:

1. A socket wrench ratchet handle structure comprising an elongated handle body having a first end to which a first ratchet head is connected, the first ratchet head having a first socket driving member received within a through hole which extends from a first face of the first ratchet head to an opposite, second face of the first ratchet head, the first socket driving member having a first driving plug extending out of the through hole from the first face in a direction away from the first face and a second driving plug extending out of the through hole from the second face in a direction away from the second face and thus opposite to the first driving plug, the first and second driving plug being so constructed to be rotatable in unison with each other and selectively rotatable in a first angular direction or an opposite second angular direction, both the first and second faces of the first ratchet head having a direction setting tab mounted thereto and connected to each other by means of a common rotational axle to be rotatable in unison for setting the first and second driving plugs to be rotatable in the first angular direction or the second angular direction.

2. The socket wrench ratchet handle structure as claimed in claim 1, wherein the handle body has a second end, opposite to the first end thereof, on which knurl is provided to form a handhold portion.

3. The socket wrench ratchet handle structure as claimed in claim 1, wherein the handle body has a second end, opposite to the first end thereof, to which a second ratchet head is connected, the second ratchet having a second socket driving member received within a through hole which extends from a first face of the second ratchet head to an opposite, second face of the second ratchet head, the second socket driving member having a third driving plug extending out of the through hole from the first face in a direction away from the first face and a fourth driving plug extending out of the through hole from the second face in a direction away from the second face and thus opposite to the third driving plug, the third and fourth driving plugs being so constructed to be rotatable in unison with each other and selectively rotatable in a first angular direction or an opposite second angular direction, both the first and second faces of the second ratchet head having a direction setting tab mounted thereto and connected to each other by means of a common rotational axle to be rotatable in unison for setting the third and fourth driving plugs to be rotatable in the first angular direction or the second angular direction.

4. The socket wrench ratchet handle structure as claimed in claim 1, wherein the handle body comprises a knuckle joint formed between the first end thereof and the first ratchet head, which comprises two spaced side walls formed on the first end of the handle body defining therebetween a recess for receiving an extension from the first ratchet head, the extension of the first ratchet head being pivoted to the side walls of the first end of the handle body by means of a pivot extending through the side walls and the extension, the first ratchet head comprising orientation adjusting means for adjusting and retaining the first ratchet at one of a plurality of particular orientations relative to the handle body.

5. The socket wrench ratchet handle structure as claimed in claim 4, wherein the orientation adjusting means comprises a plurality of dimples formed on along a round free end of the extension of the first ratchet head to be located within the recess and a retaining block which is movably received within and guided by a hole formed within the recess and biased by a spring toward the round end of the extension to have the retaining block selectively engage one of the dimples to retain the first ratchet head at a particular orientation associated with the one of the dimples.

6. The socket wrench ratchet handle structure as claimed in claim 1, wherein the handle body has a second end, opposite to the first end thereof, to which a further, individual driving plug is mounted to extend in a direction co-axial with the handle body.

7. The socket wrench ratchet handle structure as claimed in claim 6, wherein the handle body comprises a knuckle joint connected between the second end thereof and said further driving plug.

* * * * *